US005525858A

United States Patent [19]

Berton et al.

[11] Patent Number: 5,525,858

[45] Date of Patent: Jun. 11, 1996

[54] COLOR PICTURE TUBE WITH REDUCED PRIMARY AND SECONDARY MOIRE

[75] Inventors: Fabrizio Berton, Artena; Francesco Di Giamberardino, Rome, both of Italy

[73] Assignee: Videocolor, S.p.A., Anagni, Italy

[21] Appl. No.: 345,429

[22] Filed: Nov. 21, 1994

[51] Int. Cl.[6] ..... H01J 29/07

[52] U.S. Cl. ..... 313/402; 313/403

[58] Field of Search ..... 313/402, 403

[56] References Cited

U.S. PATENT DOCUMENTS

| | | | |
|---|---|---|---|
| 3,633,058 | 1/1972 | Kouno | 313/403 |
| 3,663,854 | 5/1972 | Tsuneta et al. | 313/403 |
| 3,973,159 | 8/1976 | Barten | 313/403 |
| 4,210,842 | 7/1980 | Nakayama et al. | 313/403 |
| 4,583,022 | 4/1986 | Masterton | 313/403 X |
| 4,751,425 | 6/1988 | Barten | 313/403 |
| 4,983,879 | 1/1991 | Kawaguchi | 313/402 |
| 5,030,881 | 7/1991 | Marks et al. | 313/403 |
| 5,378,959 | 1/1995 | Mancini | 313/403 X |

*Primary Examiner*—Walter E. Snow
*Assistant Examiner*—Ashok Patel
*Attorney, Agent, or Firm*—Joseph S. Tripoli; Dennis H. Irlbeck

[57] ABSTRACT

An improved color picture tube, operable in a multistandard television receiver, includes a viewing screen, a shadow mask and an electron gun for generating and projecting three electron beams through the shadow mask and onto the screen. The screen includes phosphor lines that extend in a first direction. The electron beams are subject to deflection in the first direction and in a second direction, that is substantially perpendicular to both the first direction and the phosphor lines. The shadow mask includes elongated slit-shaped apertures that are aligned in columns that substantially parallel the phosphor lines. The adjacent apertures in each column are separated from each other by tie-bars in the mask, and the tie-bars in one column are offset from the tie-bars in adjacent columns in the first direction. The improvement includes the tie-bars in alternate columns lying on substantially straight lines that form an angle of approximately 2 degrees with respect to the second direction.

1 Claim, 7 Drawing Sheets

COLOR PICTURE TUBE WITH REDUCED PRIMARY AND SECONDARY MOIRE

This invention relates to color picture tubes having shadow masks with slit-shaped apertures aligned in columns, the apertures in each column being separated by tie-bars in the mask, and particularly to a color picture tube, operable in a multistandard television receiver, having a mask with a tie-bar arrangement which reduces both primary and secondary moiré over the entire screen of the tube.

BACKGROUND OF THE INVENTION

A predominant number of color picture tubes in use today have line screens, and shadow masks that include slit-shaped apertures. The apertures are aligned in columns, and the adjacent apertures in each column are separated from each other by webs or tie-bars in the mask. Such tie-bars are essential in the mask, to maintain its integrity when it is formed into a dome-shaped contour which somewhat parallels the contour of the interior of a viewing faceplate of a tube. Tie-bars in one column are offset in the longitudinal direction of the column (vertical direction) from the tie-bars in the immediately adjacent columns. When electron beams strike the shadow mask, the tie-bars block portions of the beams, thus causing shadows on the screen immediately behind the tie-bars.

When the electron beams are repeatedly scanned in a direction perpendicular to the aperture columns (horizontal direction), they create a series of bright and dark horizontal lines on the screen. These bright and dark horizontal lines interact with the shadows formed by the tie-bars, creating lighter and darker areas which produce a wavy pattern on the screen, called a moiré pattern. Such a pattern greatly impairs the visible quality of the image displayed on the screen. Analysis of moiré in shadow mask tubes, using Fourier analysis and geometrical considerations, shows that the visibility of moiré depends mainly on the amplitude and pitch of the moiré pattern. Moiré amplitude depends on the vertical spot size and tie-bar width. Moiré pitch depends on the interference between the periodic repetitivity of tie-bar alignment and the period of scanning lines.

It is highly desirable to select a shadow mask tie-bar spacing and sizing that will minimize the moiré pattern for any scan condition used in the television receiver. The industry change from one-mode to multistandard television receivers complicates the selection such that it is necessary to reach some compromise to achieve acceptable moiré for all multistandard modes. The two scan conditions presently in use are interlaced scan and non-interlaced scan. The following Table presents the standards (interlaced and non-interlaced) that were considered in developing the present invention.

TABLE

| STANDARD | OVERSCAN | VISIBLE LINES PAL/SECAM | VISIBLE LINES NTSC |
|---|---|---|---|
| 4/3 | 107% | 537 (268) | 453 (227) |
| <4/3> | 119% | 483 (241) | |
| <<4/3>> | 137% | 420 (210) | 359 (180) |
| 16/9 | 75% | 716 (358) | |
| </9> | 83% | 647 (324) | |

In the Table, 4/3 and 16/9 represent the horizontal-to-vertical aspect ratios of the screens. The second column, labeled Overscan, presents the amount of vertical overscan of the 4/3 standard transmissions and the amount of vertical underscan of the 16/9 standard transmissions. In the 16/9 standard, there is a corresponding amount of overscan in the horizontal direction to obtain the 16/9 ratio. The third column presents number of visible lines in the standard PAL/SECAM transmission and the fourth column presents the number of visible lines in the standard NTSC transmission. For example, in the PAL transmission with 625 lines and 107% overscan, there will be 537 visible lines on the screen. The standards <4/3> and <<4/3>> are related to two zoomed modes, respectively, of 119% and 137% enlargement. Because of the enlargement, the number of viewed lines on the screen are less. Similarly, <16/9> is an enlarged mode of the 16/9 standard. The numbers in parenthesis indicate the non-interlaced modes. In actual television receivers, the modes to be considered for teletext transmission are only 268 lines for PAL and 227 lines for NTSC, but for moiré calculations it is useful also to consider the non-interlaced modes to account for the possibility of improper interlace in a receiver, which would produce some moiré.

There have been many techniques suggested to reduce the moiré problem. Most of these techniques involve either adjusting the vertical size of the electron beam spot at the screen, such as by modifying the electron gun and yoke, or rearranging the locations of the tie-bars in the mask to reduce the possibility of the electron beam scan lines beating or interacting with the tie-bar shadows. U.S. Pat. No. 4,751,425, issued to Barten on Jun. 14, 1988, shows a mask wherein the tie-bars are located on straight lines that form an angle of between 3 and 8 degrees with the horizontal direction of deflection. Although techniques, such as that shown in the Barten patent, have been used successfully in the past to achieve some reduction in moiré, they concentrate on correcting primary moiré pitch and do not consider secondary moiré pitch that arises when the inclination of tie-bar lines is introduced. Therefore, there is still a need for improved moiré reduction techniques which consider the secondary moiré pitch. Such improved techniques are needed especially for the newer higher quality color picture tubes that are required for higher definition television. For example, as the quality of electron guns improves to meet the needs of higher definition television, such improved guns produce smaller electron beam spots at the screen. This reduction in electron beam spot size produces visually sharper scan lines on the screen which interact with the tie-bar shadows and increase the moiré pattern visibility problem.

SUMMARY OF THE INVENTION

An improved color picture tube includes a viewing screen, a shadow mask and an electron gun for generating and projecting three electron beams through the shadow mask and onto the screen. The screen comprises phosphor lines that extend in a first direction. The electron beams are subject to deflection in the first direction and in a second direction, that is substantially perpendicular to both the first direction and the phosphor lines. The shadow mask includes elongated slit-shaped apertures that are aligned in columns that substantially parallel the phosphor lines. The adjacent apertures in each column are separated from each other by tie-bars in the mask, and the tie-bars in one column are offset in the first direction from the tie-bars in adjacent columns. The improvement comprises the tie-bars in alternate columns lying on substantially straight lines that form an angle of approximately 2 degrees with respect to the second direction.

DETAILED DESCRIPTION OF THE PREFERRED EMBODIMENTS

Figure 1:
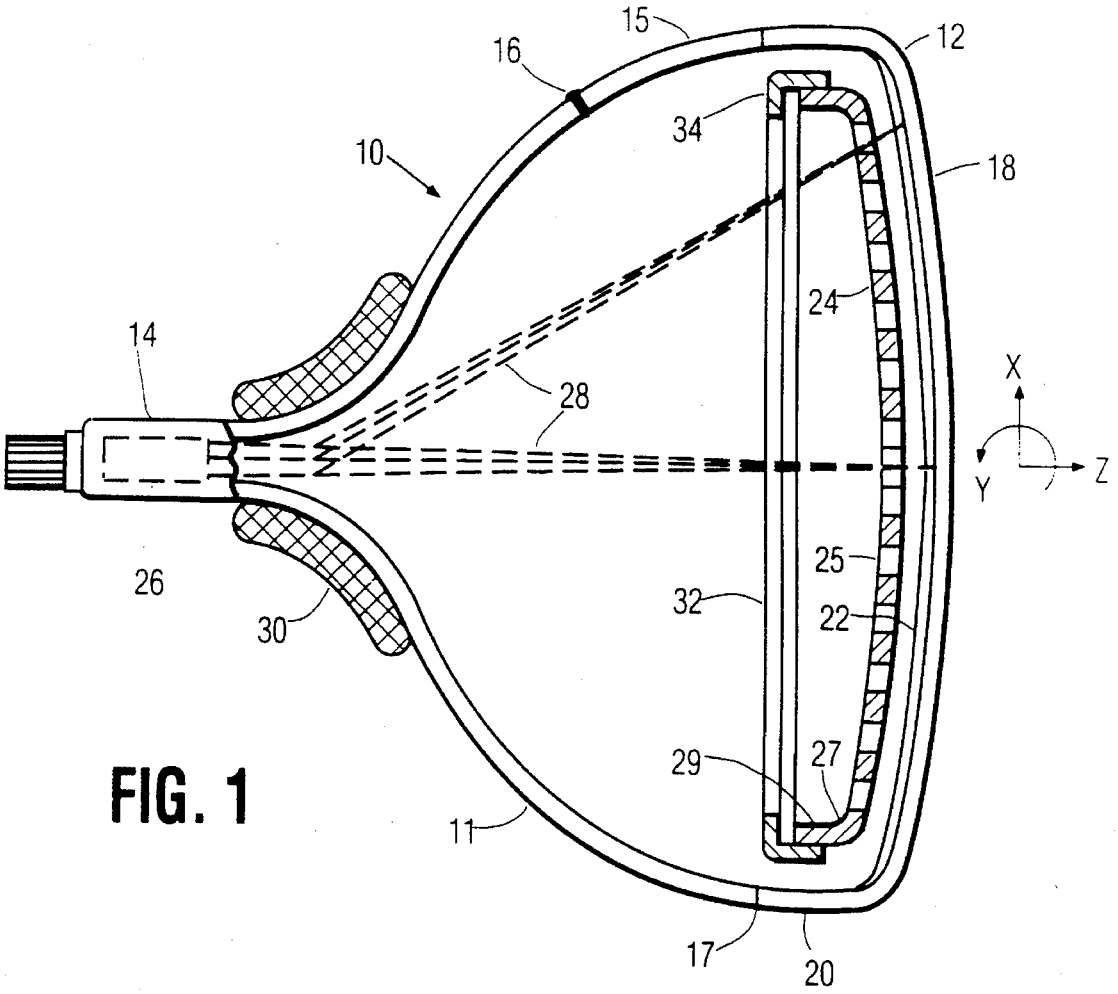
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1. The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within (as shown) or over the frame 34, and the skirt portion 29 is welded to the frame 34.

Figure 2:
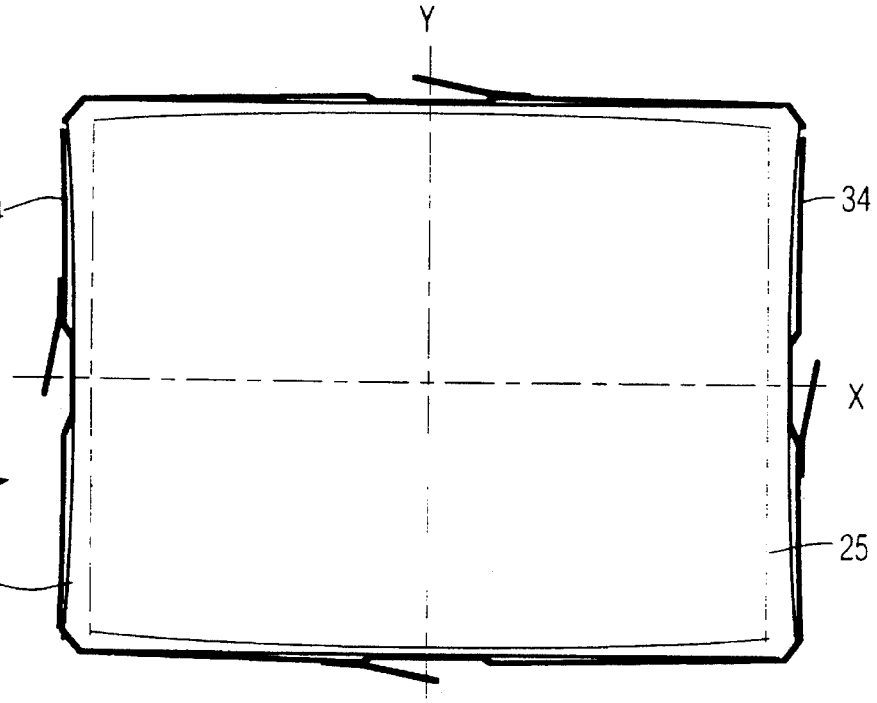
FIG. 2 is rear plan view of a faceplate panel of the tube of FIG. 1.
Figure 3:
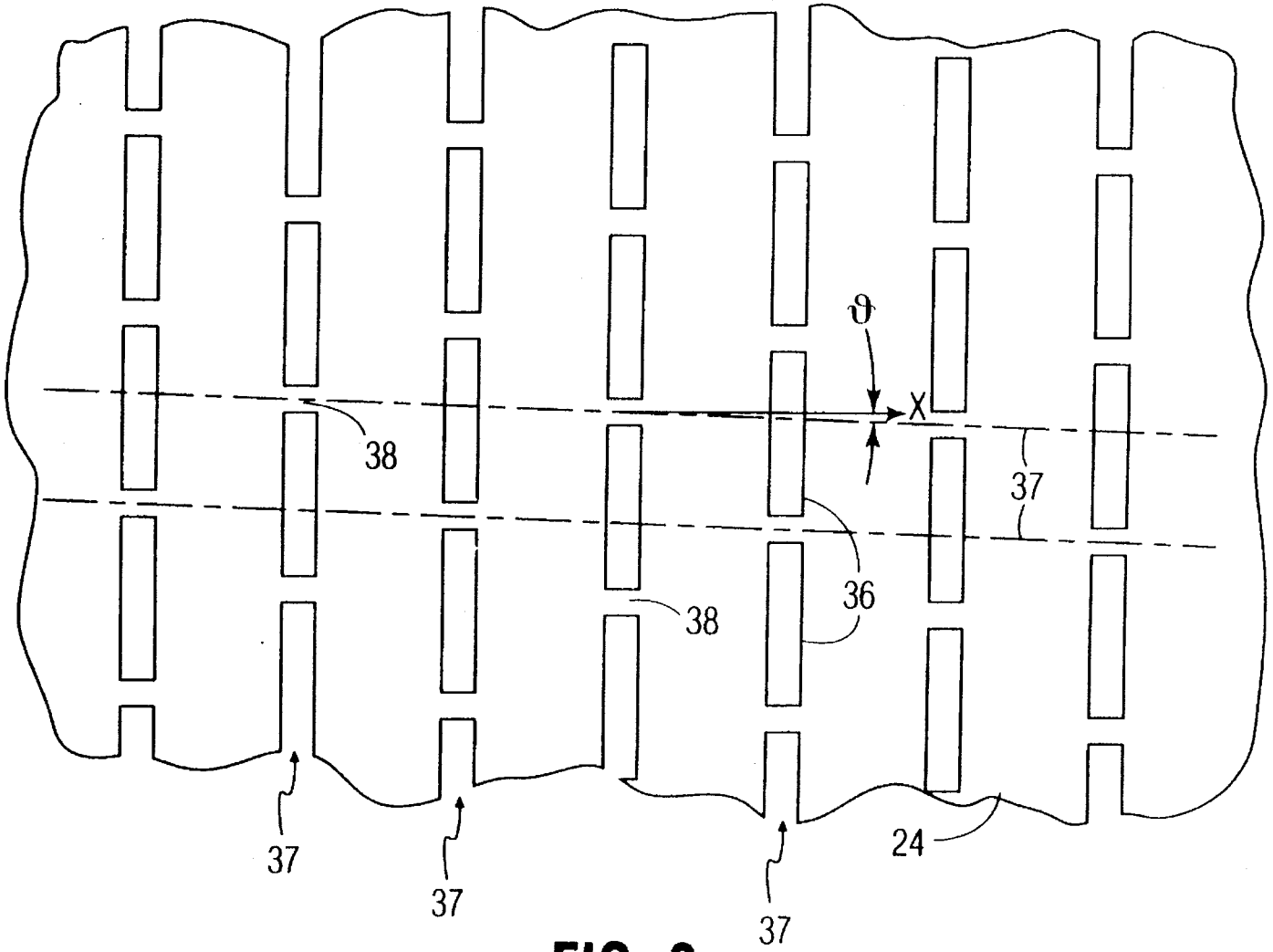
FIG. 3 is an enlarged view of a small portion of a shadow mask of the tube of FIG. 1.

The shadow mask 24, shown in greater detail in FIGS. 2 and 3, has a rectangular periphery with two long sides and two short sides. The mask 24 has a major axis X, which passes through the center of the mask and parallels the long sides and a minor axis Y, which passes through the center of the mask and parallels the short sides. The mask 24 includes elongated slit-shaped apertures 36 aligned in columns that essentially parallel the minor axis Y. Adjacent apertures 36 in each column are separated by tie-bars 38 in the mask, with the spacing between tie-bars 38 in a column being defined as the tie-bar pitch at a particular location on the mask.

Figure 4:
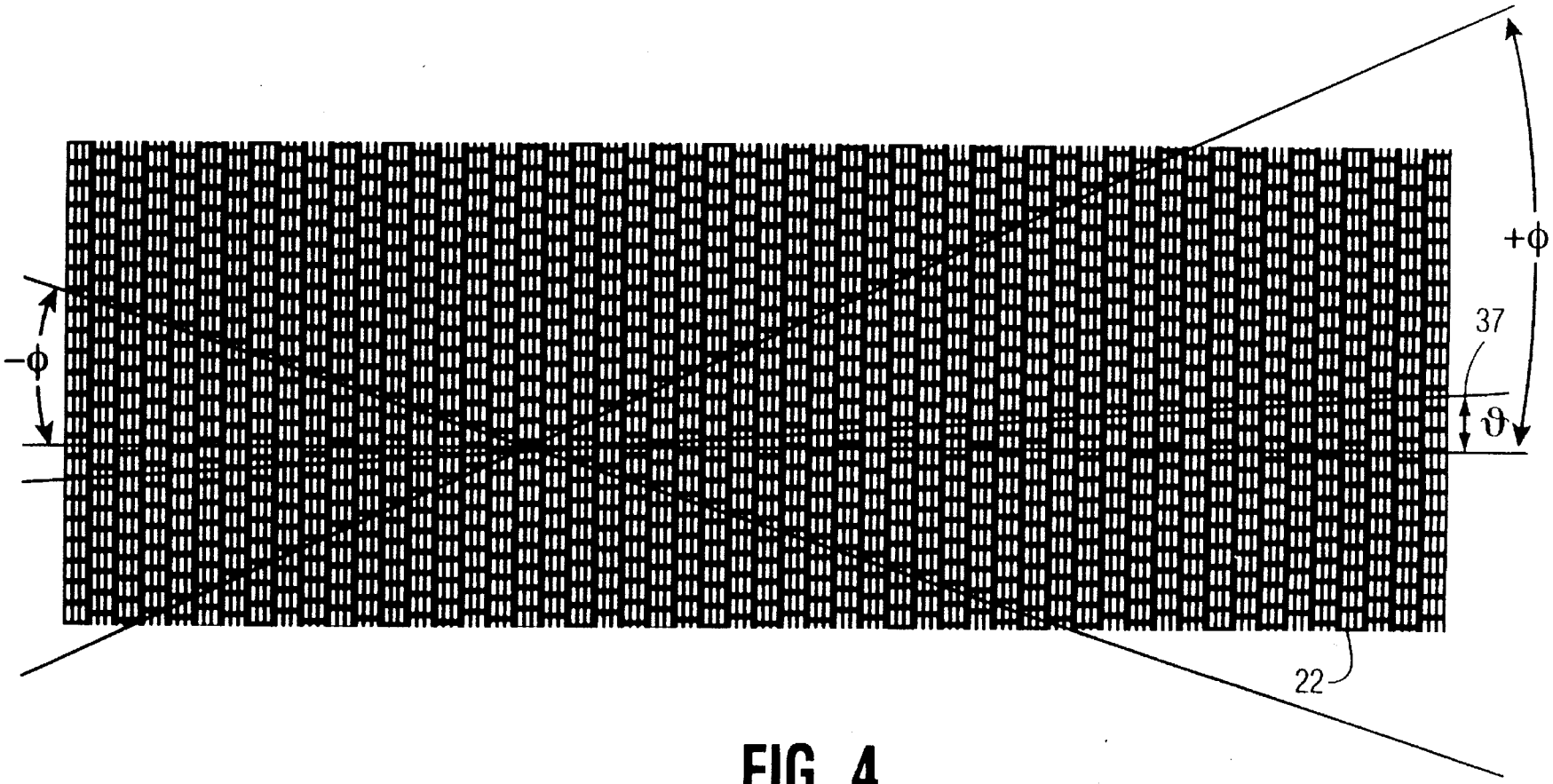
FIG. 4 is a partial view of the screen of the tube of FIG. 1, showing several angle relationships.

The above-cited U.S. Pat. No. 4,751,425 teaches that a reduction in moiré can be achieved by locating the mask tie-bars on straight lines that are angled between 3 and 8 degrees with the horizontal direction of electron beam scan. This angling of the tie-bars does reduce a primary moiré pitch. Such primary moiré pitch $P_{M1}$ can be calculated from the equation:

$$P_{M1} = \frac{\frac{P_v \cdot s}{2}}{\sqrt{\frac{P_v^2}{4} n^2 + s^2 m^2 - P_v \cdot s_{m \cdot n} \operatorname{Cos} \theta}} \tag{1}$$

where $P_v$ is the vertical mask pitch s is the scanning line spacing, θ is the tie-bar line inclination angle, n is a harmonic of the scanning line spectrum (e.g., first, second, third etc.), and m is a harmonic of the mask vertical pitch spectrum (e.g., first or second). A negative tie-bar line inclination angle θ is shown in FIG. 3, and a positive tie-bar line inclination angle θ is shown in FIG. 4. FIG. 4 is a small portion of the screen 22 of the tube 10, showing the red-green-blue phosphor line triads that are excited by electron beams passing through the mask apertures 36. The short horizontal lines in FIG. 4 are the shadows caused by the tie-bars 38 in the mask 24

Figure 5:
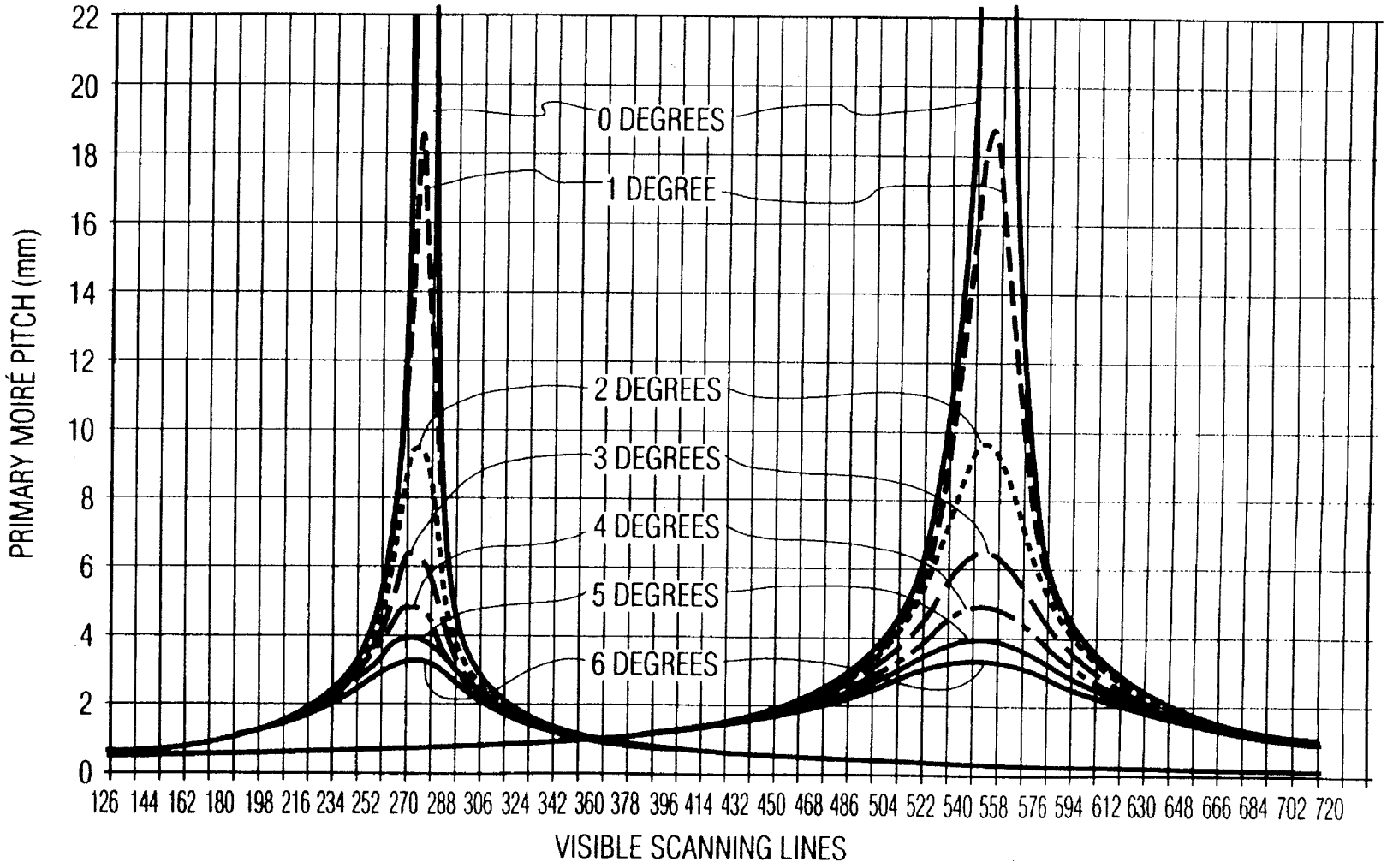
FIG. 5 is a graph showing the dependence of primary moir é pitch on row inclination versus visible scanning lines.

FIG. 5 is a graph of primary moiré pitch versus visible scanning lines, showing two harmonics that contribute to moiré for a mask with a vertical mask pitch ($P_v$) of 0.68 mm on the screen. The graph has sevens sets of curves, labeled 0 degrees to 6 degrees. These curves represent the angles formed between straight lines along the tie-bar rows and the horizontal direction of beam deflection, as disclosed in the above-cited U.S. Pat. No. 4,751,425. From the graph, it can be seen that, at either harmonic, the primary moiré pitch decreases for increases in the tie-bar row inclination. However, the inclination of the tie-bar rows produces another kind of moiré called secondary moiré. This secondary moir é results from the interference between the scanning lines and the aligned diagonal structure of tie-bars. This secondary moiré is characterized by an angle that is determinable from mask horizontal and vertical pitch using the following relation;

$$\pm Ø = \operatorname{Arc\,Tan} \frac{\frac{P_v}{2} \pm P_H \operatorname{Tan} \theta}{P_H} \tag{2}$$

in which ±Ø the secondary tie-bar inclinations that rise (counterclockwise and clockwise, respectively) from the tie-bar inclination angle θ, $P_v$ is the vertical mask pitch, and $P_H$ is the horizontal mask pitch. The secondary tie-bar inclinations ±Ø and –Ø and the tie-bar inclination angle θ are shown in FIG. 4.

The smaller of the two angles of inclination determines a secondary moiré that is very persistent on the sides of the screen, where the spot size is reduced by focusing. The secondary moiré pitch $P_{M2}$ can be calculated from the following equation;

$$P_{M2} = \frac{P_v \cdot s}{\sqrt{P_v^2 n^2 + s^2 m^2 - 2P_V \cdot s_{m \cdot n} \operatorname{Cos} \varnothing}} \quad (3)$$

Figure 6:
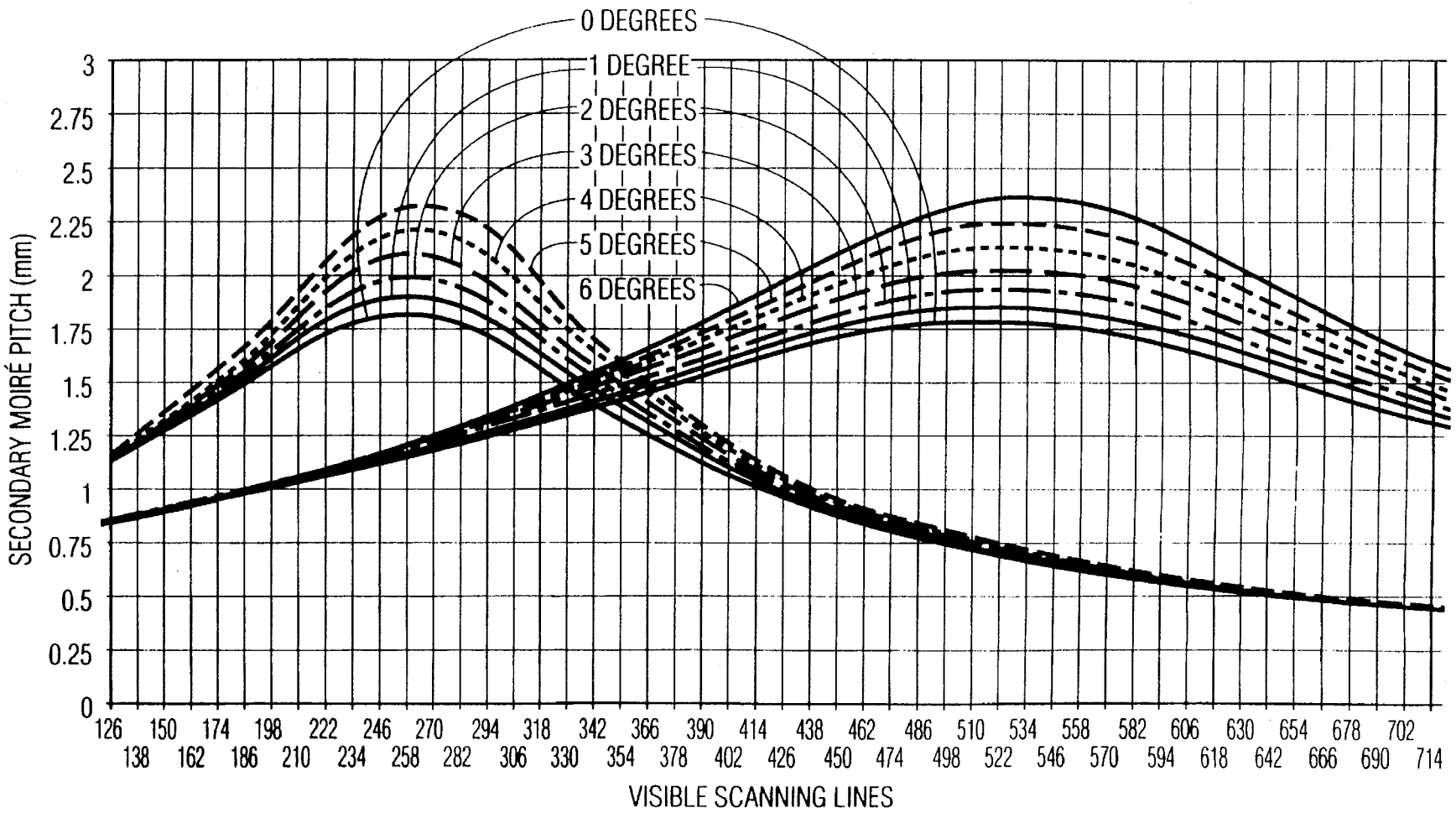
FIG. 6 is a graph showing the dependence of secondary moiré pitch on row inclination versus visible scanning lines.

FIG. 6 is a graph of secondary moiré pitch versus visible scanning lines, showing two harmonics that contribute to secondary moiré. This graph has seven curves, again representing the inclination angles of the tie-bar rows to the horizontal direction of deflection. As can be seen in the graph of FIG. 6, secondary moiré pitch increases for increases in inclination angle, an effect opposite to that for the primary moiré pitch.

It has been found that secondary moiré pitch is more visible than is the primary moiré pitch. This occurs because there is no alternate shift of the tie- bars along the diagonal lines (at angle Ø), as there is along a horizontal scan line. Therefore, a smaller reduction is required in secondary moir é pitch than in primary moiré pitch, to achieve the same visual results. Unlike in the prior art, which suggests a tie-bar row inclination of 3 to 8 degrees, the inventors here have found that improved visual results can be attained with a tie-bar inclination of approximately 2 degrees. At 2 degrees, although the primary moiré pitch is higher than it is at 3 degrees, the primary moiré pitch is less noticeable than is the secondary moiré pitch at these angles. Furthermore, at 2 degrees, the secondary moiré is near the limit of eye resolution.

Figure 7:
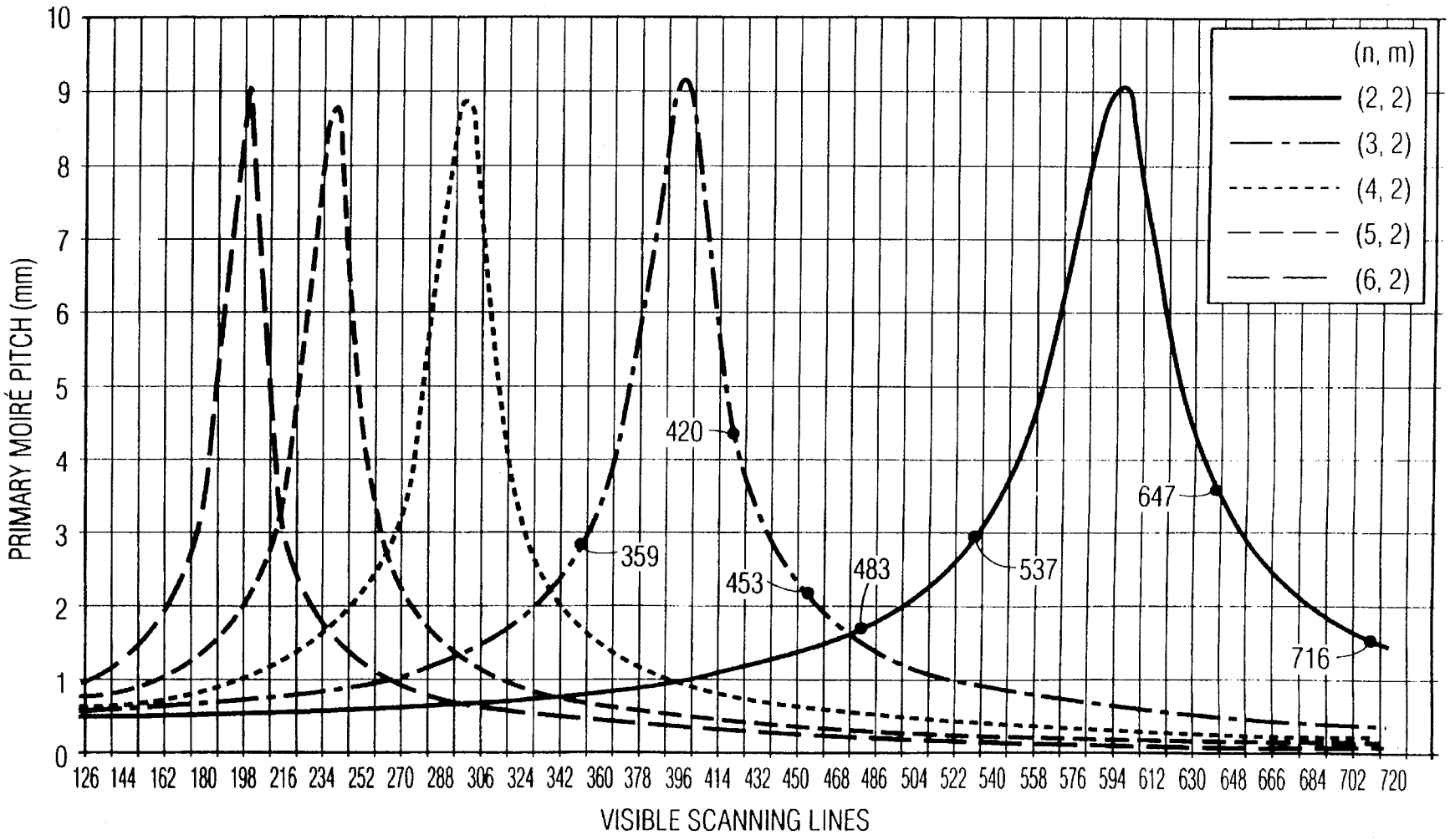
FIG. 7 is a graph showing the primary moiré pitch for an improved mask, embodying the present invention, versus visible scanning lines.

FIG. 7 is a graph showing the primary moiré pitch versus the number of visible scanning lines for a mask constructed in accordance with the present invention. In this graph, the vertical mask pitch, $P_v$, is 0.635 mm, and the tie-bar inclination angle, θ, is 2 degrees. The first harmonic is not presented in this graph, because the tie-bars in a mask in adjacent columns actually alternate by $P_v/2$ from column to column. Therefore, the mask spectrum behaves as if the vertical pitch is $P_v/2$, giving an harmonic peak for $s=P_v/2$ that permits more than 1200 visible lines. The solid line in FIG. 7 is the second harmonic, and other harmonics are shown with various broken lines.

Figure 8:
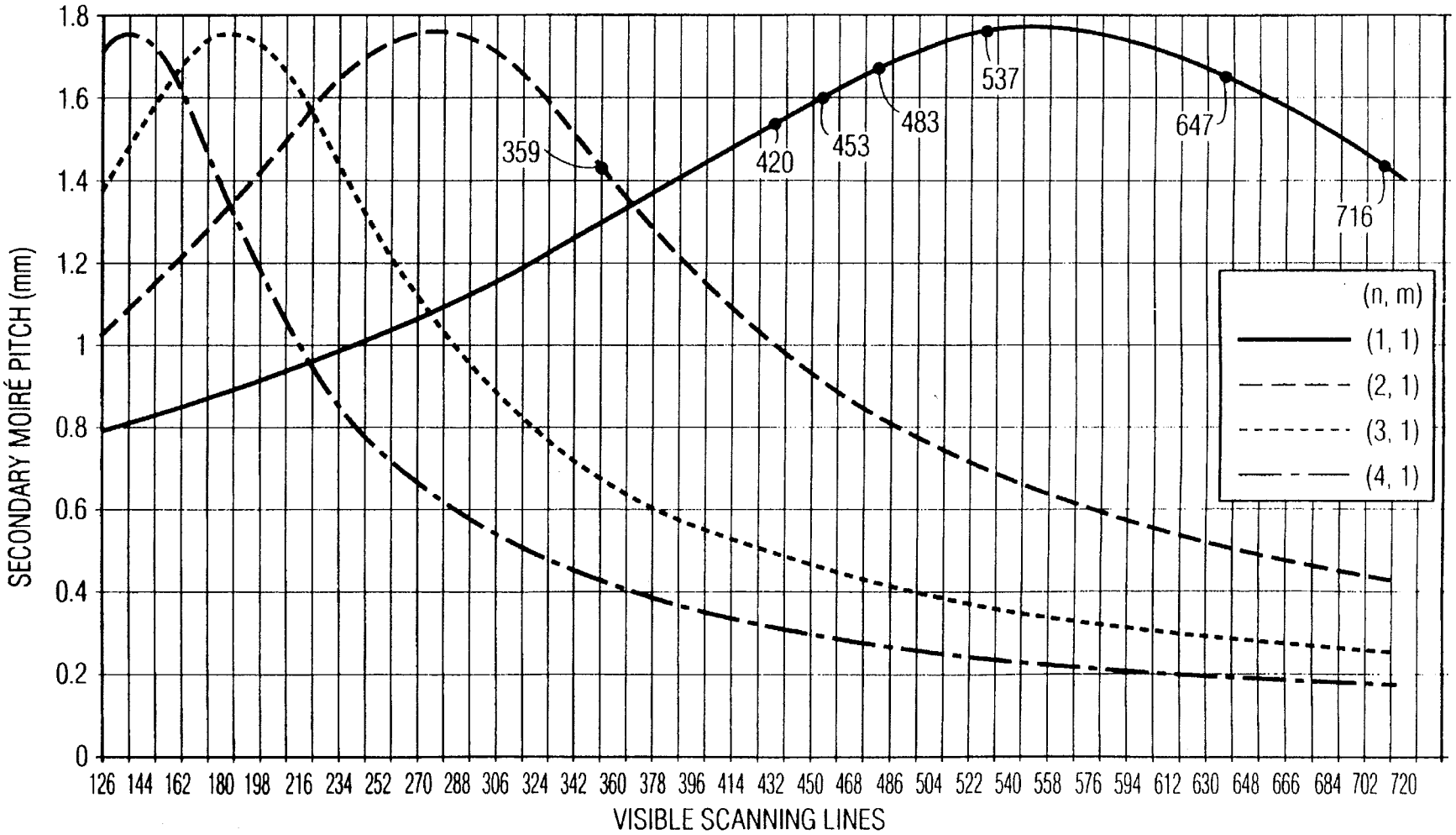
FIG. 8 is a graph showing the secondary moiré pitch for an improved mask, embodying the present invention, versus visible scanning lines.

FIG. 8 is a graph showing the secondary moiré pitch versus the number of visible scanning lines for a mask constructed in accordance with the present invention. In this graph, the vertical mask pitch, $P_v$, is 0.635 mm, and the tie-bar inclination angle, θ, is 2 degrees. The solid line in FIG. 8 is the first harmonic, and other harmonics are shown with various broken lines.

A method underlying the present invention includes a calculation of the desired tie-bar pitch for a flat mask, which takes into account many factors. First, for a given scan line pitch, the desired tie-bar shadow locations are calculated at several discrete areas, as viewed from a distance in front of the viewing screen. Such desired tie-bar shadow locations are those locations that will give a nearly optimized compromise for moiré at each of the discrete areas. Next, the corresponding tie-bar shadows on the screen are determined, taking into account the angles of beam deflection at the discrete areas. Thereafter, the corresponding tie-bar pitches are determined on the formed contoured shadow mask, taking into account the mask-to-screen spacing at each of the discrete areas. Then, the tie-bar pitches on the unformed flat mask are calculated by subtracting the stretch caused by the mask forming step. Such stretch is determined from actual measurements of vertical pitch at the discrete areas on the apertured formed mask and by comparing these measurements with measurements made on the flat mask prior to forming. This determination may include several iterative steps. Once the stretch measurements are obtained, the results are smoothed by a "least squares" fitting. Finally, a "least squares" fitting is made on the flat mask tie-bars. An evaluation of this fitting gives flat mask tie-bar locations for any X,Y location.

What is claimed is:

1. In a color picture tube including a viewing screen, a shadow mask and an electron gun for generating and projecting three electron beams through said shadow mask and onto said screen, said screen comprising phosphor lines that extend in a first direction, said electron beams being subject to deflection in said first direction and in a second direction, that is substantially perpendicular to both said first direction and said phosphor lines, said shadow mask including elongated slit-shaped apertures that are aligned in columns that substantially parallel said phosphor lines, the adjacent apertures in each column being separated from each other by tie-bars in the mask and the tie-bars in one column being offset from the tie-bars in adjacent columns in said first direction, the improvement comprising said tie-bars in alternate columns lying on substantially straight lines that form an angle of approximately 2 degrees with respect to said second direction.

* * * * *